US006674838B1

(12) United States Patent
Barrett

(10) Patent No.: US 6,674,838 B1
(45) Date of Patent: Jan. 6, 2004

(54) X-RAY TUBE HAVING A UNITARY VACUUM ENCLOSURE AND HOUSING

(75) Inventor: Vaughn Leroy Barrett, West Jordan, UT (US)

(73) Assignee: Varian Medical Systems, Inc., Palo Alto, CA (US)

( * ) Notice: Subject to any disclaimer, the term of this patent is extended or adjusted under 35 U.S.C. 154(b) by 0 days.

(21) Appl. No.: 10/010,305

(22) Filed: Nov. 8, 2001

(51) Int. Cl.[7] ..... H01J 35/10
(52) U.S. Cl. ..... 378/125
(58) Field of Search ..... 378/125–144

(56) References Cited

U.S. PATENT DOCUMENTS 5,056,126 A * 10/1991 Klostermann et al. ..... 378/127
5,446,778 A * 8/1995 Schmidt et al. ..... 378/125
6,390,875 B1 * 5/2002 Warren et al. ..... 378/127

* cited by examiner

*Primary Examiner*—Craig E. Church
(74) *Attorney, Agent, or Firm*—Workman Nydegger

(57) ABSTRACT

An improved x-ray tube is disclosed that eliminates the use of a fluid-filled outer housing for cooling tube components. The present x-ray tube includes a cathode housing in which is disposed a cathode assembly having a filament for producing electrons, and an anode housing in which is disposed a rotary anode for receiving electrons produced by the filament. An adapter plate is sized to hermetically receive therein the cathode assembly and the anode housing, thereby forming a unitary vacuum enclosure and tube housing. The improved x-ray tube is cooled by a combination of air and fluid cooling to reduce the buildup of damaging heat within the vacuum enclosure. The features of the present invention are preferably directed to an anode grounded-type x-ray tube, though other x-ray tube types may benefit therefrom.

58 Claims, 6 Drawing Sheets

X-RAY TUBE HAVING A UNITARY VACUUM ENCLOSURE AND HOUSING

BACKGROUND OF THE INVENTION

1. The Field of the Invention

The present invention generally relates to x-ray tube devices. More specifically, the present invention relates to an x-ray tube wherein the need for a fluid-filled outer housing is eliminated.

2. The Relevant Technology

X-ray generating devices are extremely valuable tools that are used in a wide variety of applications, both industrial and medical. For example, such equipment is commonly employed in areas such as medical diagnostic examination, therapeutic radiology, semiconductor fabrication, and materials analysis.

Regardless of the applications in which they are employed, most x-ray generating devices operate in a similar fashion. X-rays are produced in such devices when electrons are emitted, accelerated, then impinged upon a material of a particular composition. This process typically takes place within an x-ray tube located in the x-ray generating device. The x-ray tube generally comprises a vacuum enclosure, a cathode, and an anode. The cathode, having a filament for emitting electrons, is disposed within the vacuum enclosure, as is the anode that is oriented to receive the electrons emitted by the cathode. The vacuum enclosure may be composed of metal (such as copper), glass, ceramic, or a combination thereof, and is typically disposed within an outer housing. The entire outer housing is typically covered with a shielding layer composed of lead for preventing the escape of x-rays produced within the vacuum enclosure. In addition, a cooling medium, such as a dielectric oil, is typically disposed in the volume existing between the outer housing and the vacuum enclosure in order to dissipate heat from the surface of the vacuum enclosure. The oil may be cooled by circulating it to an external heat exchanger via a pump and fluid conduits disposed in the outer housing.

In operation, an electric current is supplied to the cathode filament, causing it to emit a stream of electrons by thermionic emission. In anode grounded x-ray tubes, a high negative electric potential is placed on the cathode while the anode is electrically grounded. This causes the electron stream to gain kinetic energy and accelerate toward a target surface disposed on the anode. Upon approaching and striking the target surface, many of the electrons convert their kinetic energy and either emit, or cause the target surface material to emit, electromagnetic radiation of very high frequency, i.e., x-rays. The specific frequency of the x-rays produced depends in large part on the type of material used to form the anode target surface. Target surface materials having high atomic numbers ("Z numbers"), such as tungsten carbide or TZM (an alloy of titanium, zirconium, and molybdenum) are typically employed. The x-rays are then collimated so that they exit the x-ray device through windows disposed in the vacuum enclosure and outer housing, and enter the x-ray subject, such as a medical patient.

A recurrent problem encountered with the operation of x-ray tubes deals with the removal of heat therefrom. In general, only a small percentage of the electrons that impact the anode target surface during x-ray production do, in fact, produce x-rays. The majority are instead absorbed into the anode target surface and surrounding areas, thereby creating large quantities of heat. This heat must be continuously and reliably removed from the anode and surrounding areas in order to prevent damage to critical tube components. To the extent that the heat is efficiently removed, less thermal and mechanical stress is imposed upon the x-ray tube, and its operation and performance will be enhanced. If the heat is allowed to buildup to detrimental levels, however, it can damage the anode and/or other tube components, and can reduce the operating life of the x-ray tube and/or the performance and operating efficiency of the tube.

Many approaches have been implemented to help alleviate the problems created by heating within the x-ray tube. For instance, in many x-ray tubes the anode, which typically comprises a substrate and a target surface disposed thereon, is formed in the shape of a disk. The rotary anode (also referred to as the rotary target or the anode disk) is then mounted on a supporting shaft and rotor assembly that can then be rotated by some type of motor, such as a stator. During operation of the x-ray tube, the rotary anode is rotated at high speeds, which causes successive portions of the target surface to continuously rotate into and out of the path of the electron beam produced by the cathode filament. In this way, the electron beam is in contact with any given point on the target surface for only short periods of time. This allows the remaining portion of the surface to cool during the time that it takes to rotate back into the path of the electron beam, thereby spreading the heat absorbed by the anode.

While the rotating nature of the anode reduces the amount of heat present at the target surface, a large amount of heat is still absorbed by the anode substrate, the rotor assembly, the cathode, and other components within the vacuum enclosure. This heat must be continuously and reliably removed to prevent damage to the tube (and any other adjacent electrical components) and to increase the x-ray tube's efficiency and overall service life.

One approach has been to place the vacuum enclosure within an outer housing, as mentioned above. This outer housing must serve several functions. First, it must act as a radiation shield to prevent radiation leakage resulting from the production of x-rays within the vacuum enclosure. To do so, the can must include a radiation shield, which must be constructed from some type of dense, x-ray absorbing metal, such as lead. Second, the outer housing serves as a container for a cooling medium, such as a dielectric oil, which surrounds and envelops the vacuum enclosure, and which may be continuously circulated by a pump about the outer surface thereof As heat is emitted from the x-ray tube components (anode, support shaft, etc.), it is radiated to the outer surface of the vacuum enclosure, and then at least partially absorbed by the dielectric oil. The heated oil is then passed to some form of heat exchange device, such as a radiative surface, and then cooled. The oil is then recirculated by the pump back through the outer housing and the process repeated.

While useful as a heat removal medium and/or as an electrical insulator, the use of oil and similar liquid coolants/dielectrics that surround and envelop the vacuum enclosure can be problematic in several respects. For example, use of large amounts of cooling fluid adds complexity to the construction and operation of the x-ray generating device. Use of fluid to envelop the vacuum enclosure requires that there be an outer housing as outlined above to retain the fluid. This outer housing must be constructed of a material that is capable of blocking x-rays, and it must be large enough to be completely disposed about the inner evacuated housing to retain the cooling fluid. This increases the cost and manufacturing complexity of the device. Also, the outer housing requires a large amount of physical space, resulting in the need for a larger x-ray generating device. Similarly, the space required for the outer housing reduces the amount of space that can be utilized by the inner vacuum enclosure, which in turn limits the amount of space that can be used by other components within the x-ray tube. For example, the size of the rotating anode is limited; a larger diameter anode is desirable because it is better able to dissipate heat as it rotates.

In light of the above discussion, therefore, a need exists for an x-ray tube that eliminates the problems associated with fluid-filled outer housings. Further, a need exists to provide an x-ray tube whereby sufficient cooling of the vacuum enclosure is efficiently attained, thereby improving the performance and longevity of the x-ray tube. Moreover, an x-ray tube having a simple construction and flexible design would be an advancement in the art.

BRIEF SUMMARY OF THE INVENTION

In accordance with the needs outlined above, an improved x-ray tube is provided wherein the housing thereof comprises a unitary vacuum enclosure in which is disposed the cathode, anode, and associated components. The heat created by components of the present x-ray tube is cooperatively dissipated by way of limited fluid and air cooling systems. In this way, problems associated with an outer housing and a cooling fluid disposed therein are avoided.

Generally, the present x-ray tube comprises an adapter plate to which is connected a cathode assembly and an anode housing. These three components are hermetically attached such that they form the unitary vacuum enclosure of the tube. The vacuum enclosure is designed in such a way as to not require a cooling fluid to envelop it; rather a directed fluid cooling system is combined with an air cooling system to efficiently cool the x-ray tube components during operation.

In one presently preferred embodiment, the present x-ray tube comprises an adapter plate composed of stainless steel. A first hole is defined on the adapter plate to receive a portion of a cathode assembly, which comprises a filament and a cathode shield. A cathode housing is preferably disposed about the cathode assembly. The cathode assembly and adapter plate are sealably attached to one another, with the cathode assembly being disposed on a first side of the adapter plate. On a second side of the adapter plate, an anode housing, in which is disposed an anode assembly, is sealably attached. The anode assembly is rotatably supported within the anode housing via a support shaft, which is in turn received by and fixedly attached to a second hole defined in the adapter plate.

A circular cavity is preferably defined on the second side of the adapter plate. The inner surface of the cavity defines a volume that is sized to receive therein a portion of the target surface of the rotary anode. A window is disposed in a hole defined on the edge of the adapter plate such that x-rays produced on the target surface of the rotary anode are emitted through the window.

Specific portions of the x-ray tube of the present invention are cooled by a fluid, such as water, thereby dissipating heat from those areas of the tube where heat buildup is most likely to occur. Unlike the cooling that occurs with fluid-filled outer housings, however, the fluid cooling system of the present invention utilizes fluid passageways defined in portions of the cathode and the anode housing to direct the cooling fluid. During tube operation, heat produced in the anode and cathode portions of the present x-ray tube is conducted to the regions immediately surrounding the fluid passageways. The heat is then absorbed by the circulating cooling fluid and removed from the tube by a pump. The heated fluid then enters a cooling unit, such as a heat exchanger or radiator, where the fluid is cooled and conditioned before being re-circulated into the fluid passageways within the x-ray tube.

In addition to fluid cooling, the present x-ray tube also utilizes air cooling to remove heat from tube components such as the stator. In a preferred embodiment, a fan shroud is disposed about the stator, which in turn is disposed about and affixed to a portion of the anode housing. The shroud has defined in its outer surface air inlet holes and air outlet holes. The holes provide a supply and escape for air that is circulated past the stator by way of a fan disposed near the bottom of the fan shroud. Heat that is produced by the stator during tube operation is transmitted to the air circulating past it, which air then exits the shroud via the outlet holes.

Portions of the anode housing, adapter plate, and cathode housing are preferably shielded to prevent the escape of x-rays from within the vacuum enclosure. Such shielding may be provided by a layer of lead or other suitable material disposed on the exterior of the vacuum enclosure.

Alternative embodiments include modifications to the adapter plate such that the window is disposed in the anode housing instead of the plate, and disposing an extension ring between the anode housing and adapter plate in order to more easily join the two components.

The improved x-ray tube of the present invention is simpler and smaller than previous tubes having a fluid-filled outer housing. The simplicity of the present tube reduces manufacturing costs, while its smaller size provides additional options with respect to the physical placement of the tube in a particular application, or possible enhancements thereto (such as the placement therein of a larger diameter anode) that were impossible before because of space restrictions within the tube caused by the outer housing and the cooling fluid disposed therein. Further, the present x-ray tube is lighter than the prior design, which improves ease of handling and operating. Though features of the present invention are preferably directed to x-ray tubes having electrically grounded anodes, other x-ray tube configurations may also benefit where a fluid-filled outer housing is not desired.

These and other features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof that are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

Reference will now be made to figures wherein like structures will be provided with like reference designations. It is understood that the drawings are diagrammatic and schematic representations of presently preferred embodiments of the invention, and are not limiting of the present invention nor are they necessarily drawn to scale. FIGS. 1–6 depict several embodiments of the present invention, which is directed to an improved x-ray tube having a unitary vacuum enclosure and housing. An x-ray tube constructed in this manner is smaller, lighter, and less problematic than prior tube designs utilizing a fluid-filled outer housing.

Figure 1:
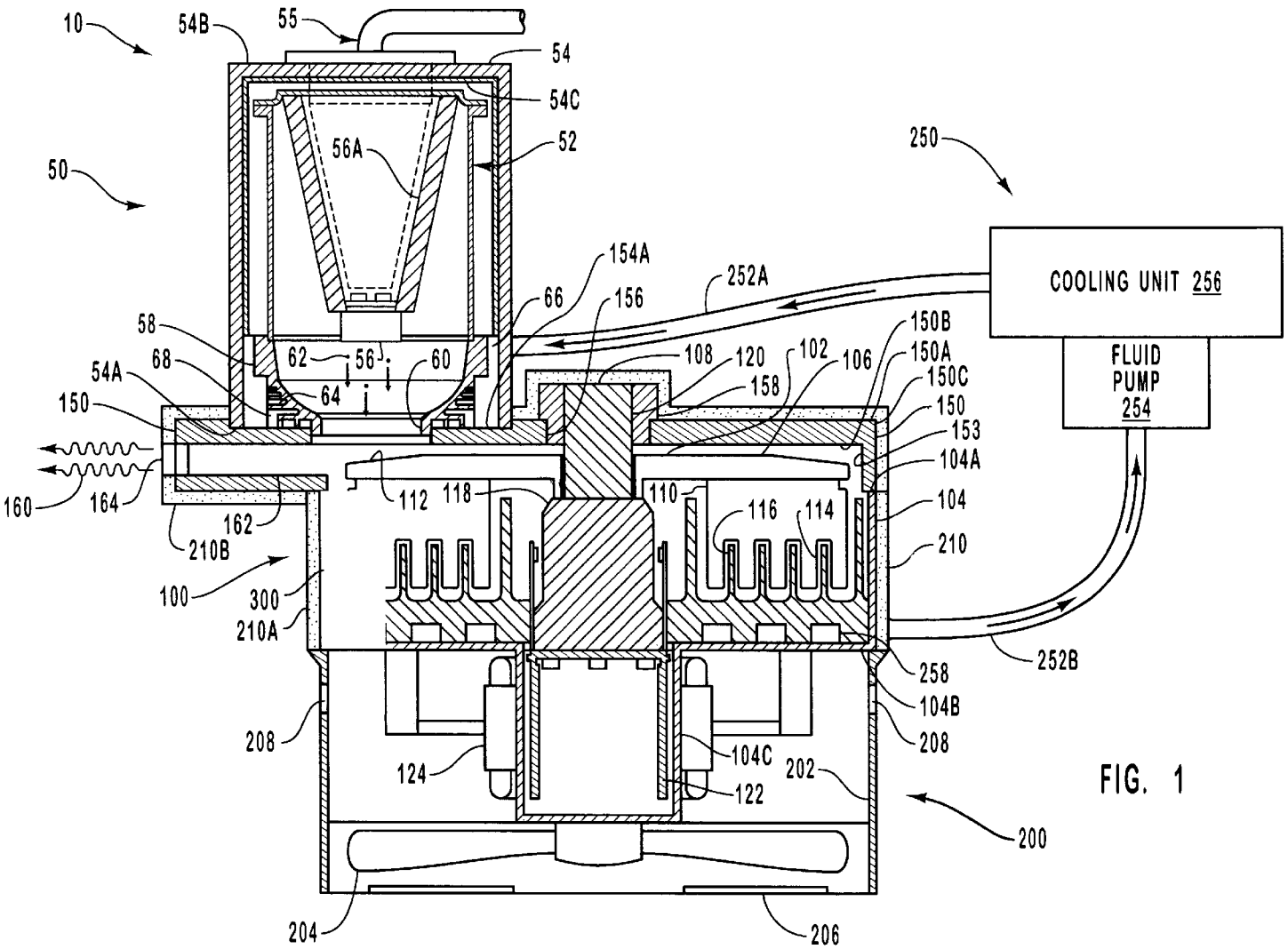
FIG. 1 is a cross-sectional side view of the x-ray tube as provided in one presently preferred embodiment of the present invention.

Reference is first made to FIG. 1, wherein is depicted one preferred embodiment of the present x-ray tube, designated generally at 10. The present x-ray tube 10 generally comprises a cathode portion 50, an anode portion 100, an adapter plate 150, a fan portion 200, and a fluid circulation system 250. A part of the cathode portion 50, together with the anode portion 100 and the adapter plate 150 hermetically attach together to form a unitary vacuum enclosure 300. The unitary enclosure 300, in conjunction with the complementary components to be described further below, provides the necessary envelope for housing the critical components of the tube 10 while providing the shielding and cooling necessary for proper x-ray tube operation.

Continuing reference is made to FIG. 1, wherein details of various portions of the improved x-ray tube 10 are discussed. The cathode portion 50, generally comprising a cathode assembly 52 and a cathode housing 54, is responsible for supplying an stream of electrons for producing x-rays as previously described. The cathode housing 54 preferably comprises a hollow cylindrical tube having an open end 54A and a closed end 54B, which includes an opening to accommodate a high voltage connector assembly 55. The housing 54 preferably comprises stainless steel or similar material. A shielding layer 54C of lead or the like is preferably disposed on the inner surface of the housing 54.

The interior volume of the cathode housing has disposed within it the cathode assembly 52. The cathode assembly 52 includes a filament 56 supported by a filament support structure 56A. The filament 56 is appropriately connected to an electrical power source (not shown) to enable the production by the filament of high-energy electrons. A cathode aperture shield 58 defines an aperture 60 that is positioned between the filament 56 and the anode target surface 112 to allow electrons 62 to pass. The aperture shield 58 is affixed to the support structure 56A such that a hermetic seal is formed between the aperture shield 58 and the support structure. The aperture shield 58 is preferably cooled via a fluid cooling system 250, described further below. Such cooling is preferable in order to remove heat that is created in the aperture shield 58 as a result of errant electrons impacting the aperture shield surface.

Continuing reference is made to FIG. 1, wherein details of the anode portion 100 are disclosed. The anode portion 100, generally comprising an anode assembly 102 and an anode housing 104, is responsible for receiving the electrons 62 produced by the filament 56 of the cathode assembly 52 and converting them into x-rays 160 to be emitted by the improved x-ray tube 10. The anode housing 104 comprises a hollow cylindrical body, preferably composed of stainless steel or similar material, having an open end 104A and a closed end 104B. The central portion of the closed end 104B further defines a hollow cylindrical extension 104C that extends below the plane in which the rest of the closed end 104B is disposed. It is noted here that words such as above, below, upper, and lower, are merely descriptive terms used to enable a sufficient description of the present invention to be made. Indeed, it is appreciated that the present improved x-ray tube 10 could be disposed in a variety of spatial orientations without affecting the functionality thereof. Accordingly, such words are not meant to limit the scope of the present invention in any way.

The anode assembly 102 is disposed within the volume created by the anode housing 104. The anode assembly 102 comprises an anode 106, and an anode support assembly 108. The anode 106 comprises a substrate 110 preferably composed of graphite, and a target surface 112 disposed thereon. The target surface 112 preferably comprises TZM or a similar alloy. The graphite substrate 110 has defined on its lower surface a plurality of concentric annular grooves 114. The grooves 114 cooperatively interleave with concentric annular extended surfaces 116 defined on the closed end 104B of the anode housing 104. The grooves 114 and the extended surfaces 116 are designed to continuously remove heat from the anode 106 during tube operation. As mentioned above, large quantities of heat accumulate in the anode 106 during x-ray production. Much of that heat is conducted to the graphite substrate 110 surrounding the grooves 114. The spacing between the grooves 114 and the extended surfaces 116 is minimal, thereby allowing the heat created in the anode 106 during tube operation to be radiated from the grooves to the extended surfaces despite the rotation of the anode. The heat is then removed from the extended surface 116 via the fluid cooling system 250 as discussed further below. Stainless steel is a preferred material from which to form the extended surfaces 116 because it possesses a low coefficient of thermal expansion, that is, it tends not to greatly expand when heated. This is a critical quality for the extended surfaces to possess, given the minimal clearance that exists between the extended surface 116 and the grooves 114. Advantageously, graphite, in which the grooves 114 are defined, also possesses a low thermal expansion coefficient.

The anode 106 is supported by the anode support assembly 108, which generally comprises a bearing assembly 118, a support shaft 120, and a rotor sleeve 122. The support shaft 120 is fixedly attached to a portion of the adapter plate 150, as described further below. The anode 106 is rotatably disposed about the stationary support shaft 120 via the bearing assembly 118, thereby enabling the anode to rotate with respect to the support shaft 120. The bearing assembly 118 and the rotor sleeve 122 substantially occupy the volume created by the cylindrical extension 104C of the anode housing 104. A stator 124 is circumferentially disposed about the anode housing extension 104C and the rotor sleeve 122 disposed therein. As is well known, the stator utilizes rotational electromagnetic fields to cause the rotor sleeve 122 to rotate. The rotor sleeve 122 is fixedly attached to the anode 106, thereby providing the needed rotation of the anode during tube operation.

Figure 2A:
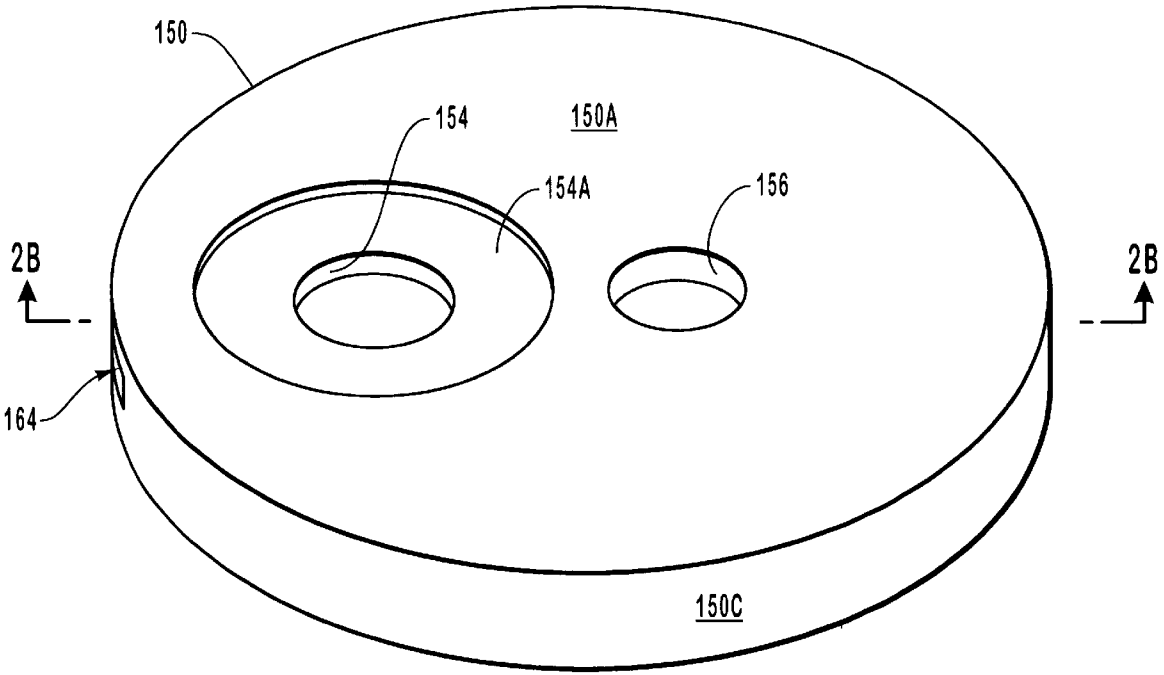
FIG. 2A is perspective view of the adapter plate included in the presently preferred embodiment of the present invention.
Figure 2B:
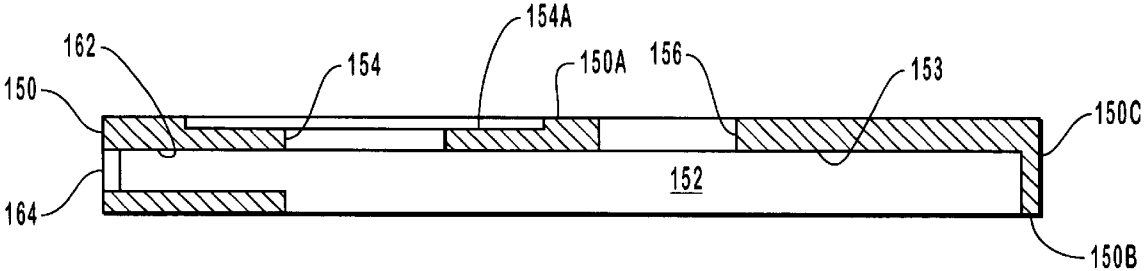
FIG. 2B is a cross-sectional side view of the adapter plate of FIG. 2A, taken along the line B—B.
Figure 3A:
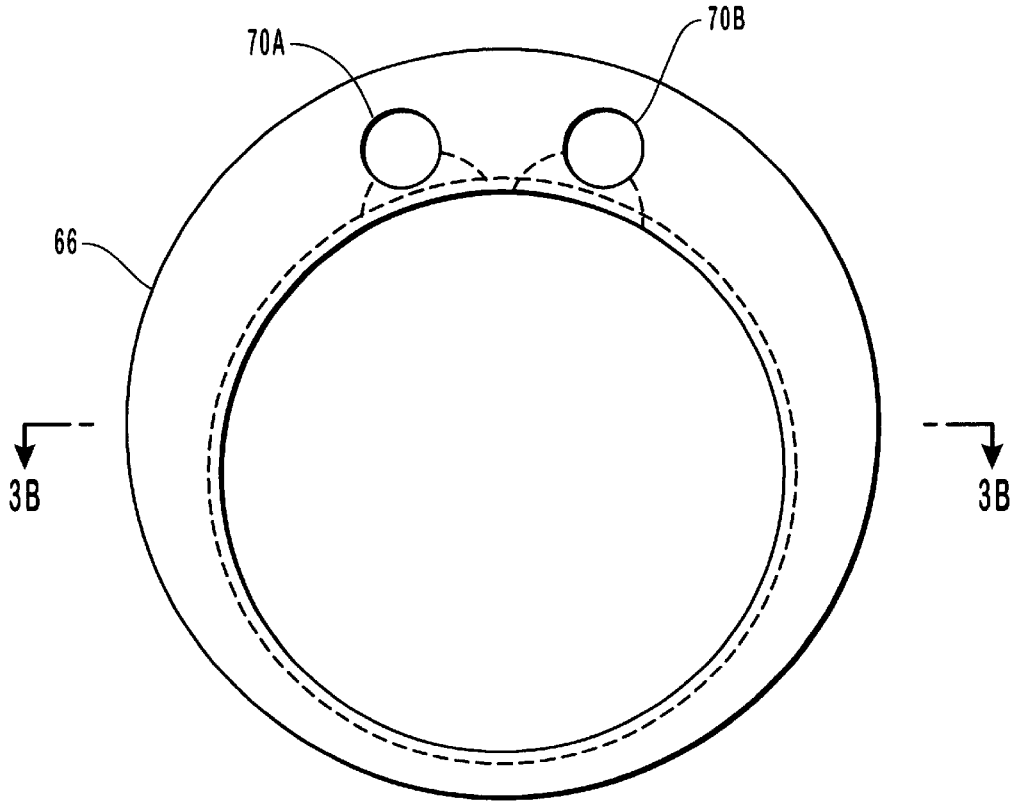
FIG. 3A is a top view of a cathode sleeve as disclosed in accordance with a presently preferred embodiment of the present invention.
Figure 3B:
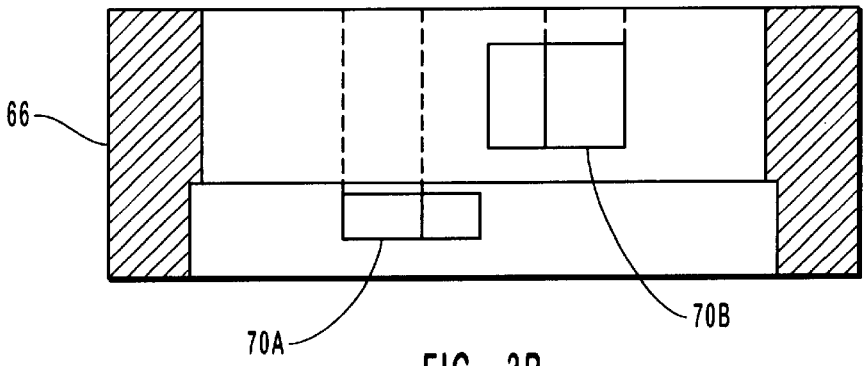
FIG. 3B is a cross-sectional side view of the cathode sleeve of FIG. 3A, taken along the line B—B.

Attention is now directed to FIGS. 1, 2A, and 2B, wherein details concerning the adapter plate 150 are disclosed. Preferably, the adapter plate 150 comprises a circular stainless steel slab having a first side 150A, a second side 150B, and a circumferential edge 150C. Alternatively, however, the plate, instead of having a circular shape, may comprise one of a variety of shapes and dimensions, such as a square or oval, as may be appreciated by one of skill in the art. In place of stainless steel, similar materials, such as tungsten alloys, could also be utilized to form the adapter plate 150. The adapter plate 150 may be formed using known techniques, such as casting, machining, or milling.

Preferably, an inner cavity 152 is defined by an inner surface 153 that inwardly extends from the second side 150B of the plate 150. The cavity 152 is sized to receive therein a portion of the anode 106, as explained below. Two holes 154 and 156 are defined on the first side 150A of the plate 150 and extend to the cavity 152. The first hole 154 is defined off-center on the plate 150 and is sized to fixedly receive therein a portion of the cathode assembly 52. Specifically, a hermetic seal is formed between the cathode aperture shield 58 and the adapter plate 150 by known methods, such as brazing or welding. About the first hole 154 may be defined a circular depression 154A for receiving therein the open end 54A of the cathode housing 54. The housing is also preferably brazed or welded to the adapter plate 150.

The second hole 156 is defined by the adapter plate 150 and enables the anode assembly 102 to be rotatably supported by the plate. Preferably, the hole 156 is sized to receive therein, and have brazed thereto, a hollow, cylindrical mounting sleeve 158. The sleeve 158, in turn, fixedly receives one end of the support shaft 120. The attachment of the support shaft 120 to the sleeve 158 may be accomplished by brazing, welding, interference fitting, or by other known methods. Additionally, it is appreciated that there exist other ways by which the anode assembly 102 may be supported within the unitary vacuum enclosure 300. Such other ways are accordingly contemplated as residing within the claims of the present invention.

The open end 104A of the anode housing 104 is affixed to the second side 150B of the adapter plate 150 in such a way as to form a hermetic seal therebetween. Such a seal may be formed by brazing or welding the two components together. In this way, the unitary vacuum enclosure 300 is formed by the hermetic junction of the cathode assembly 52, the adapter plate 150, and the anode housing 104, as shown in FIG. 1. The filament 56 and the target surface 112, both being disposed within the vacuum enclosure 300 of the anode 106, are aligned such that the electrons 62 that are produced and emitted by the filament 56 during tube operation are able to pass through the cathode aperture shield 58, the cathode assembly mounting hole 154, and into the inner plate cavity 152, where they strike the rotating target surface 112, thereby producing x-rays 160, as previously outlined.

Preferably, the anode 106 is disposed within the space created by the interior volume of the anode housing and the inner plate cavity 152 such that the target surface 112 of the anode 106 resides within the inner plate cavity. A tunnel 162 is defined in the circumferential edge 150C of the adapter plate 150 that extends to the inner cavity surface 153. A window 164, preferably comprising beryllium, is disposed at the outer end of the tunnel 162 such that x-rays produced by the impingement of electrons on the target surface 112 during tube operation pass through the tunnel and exit the window. Alternatively, the window may be disposed in other locations in the improved x-ray tube 10, as discussed further below.

In the presently preferred embodiment, portions of the improved x-ray tube 10 are air cooled by the fan portion 200 to remove heat from the tube. Specifically, the stator 124 is air-cooled by continuously circulating air thereabout. To accomplish this, the fan portion 200 preferably comprises a fan shroud 202, preferably composed of stainless steel and disposed both about the stator 124 and about the extension 104C of the anode housing 104. The shroud 202 preferably has a hollow cylindrical shape and is fixedly attached to the closed end 104B of the anode housing 104via welding, brazing, or the like. A fan 204 is disposed near the bottom of the fan shroud 202, as depicted in FIG. 1. The fan 204 is powered by a motor (not shown) and is oriented to direct a continuous stream of air over the outer surface of the stator 124. One or more air inlet ports 206 are disposed near the bottom of the fan shroud, as are one or more air outlet ports 208 disposed near the top thereof. During tube operation, air is drawn in through the air inlet ports 206 by the circulation of the fan 204, which air is then forced over the stator 124. The heat created by the operation of the stator 124 is radiated to the passing air before the air exits the air outlet ports 208. In this In order to prevent the emission of x-rays from the unitary vacuum enclosure 300 during tube operation, the presently preferred embodiment of the improved x-ray tube 10 has disposed about portions of the tube a layer of shielding 210 capable of absorbing an x-ray 160 that may escape. Preferably composed of lead, the shielding 210 may comprise two parts. A first shielding portion 210A comprises a hollow cylindrical tube circumferentially disposed about the anode housing 104 between the open end 104A and the closed end 104B. The shielding portion 210A has one end thereof fixedly attached to the top end of the fan shroud 202. A brazement or weld may be utilized to attach the shielding portion 210A to the fan shroud 202. The shielding portion 210A preferably possesses an inner diameter that is larger than the outer diameter of the anode housing 104 such that a small spacing exists therebetween. Alternatively, the shielding portion 210A may disposed about the anode housing by other methods, including affixing it to the outer surface of the anode housing 104, or chemical deposition to the anode housing. No shielding is required on the closed end 104B or the extension 104C of the anode housing 104 because the anode substrate 110 sufficiently absorbs any x-rays 160 that are emitted in that direction.

A second shielding portion 210B is disposed about the outer surface of the adapter plate 150. As can be seen in FIG. 1, the shielding portion 210B preferably extends as a covering around the interface of the adapter plate 150 with the end 54A of the cathode housing 54, around the window 164, over the mounting sleeve 158 and the end of the support shaft 120, and to the edge of the shielding portion 210A. Like the shielding portion 210A, the shielding portion 210B preferably comprises lead. The portion 210B is preferably affixed to the adapter plate 150 by brazing, welding, or the like. Alternatively, the portion 210B may be deposited on the outer surface of the adapter plate 150 by chemical deposition or similar processes. Moreover, shielding portions 210A and 210B might be integrally formed such that they comprise a unitary structure. Or, several shielding portions could comprise the shielding 210. Such and other modifications to the shielding 210 that may be appreciated by one who is skilled in the art are accordingly appreciated as residing within the claims of the present invention.

In addition to the air cooling of the present x-ray tube 10 as described above, the improved x-ray tube is also preferably fluid cooled in selected areas where specific heat removal is desired. Specifically, the cathode aperture shield 58 and the anode 106 are cooled via the fluid circulation system 250. The fluid circulation system 250 is used to continuously circulate a cooling fluid, such as water, through areas of the x-ray tube during operation thereof, in order to cool those areas. As contemplated herein, "fluid" is understood to comprise liquids and gases, or a mixture thereof.

As seen in FIG. 1, the fluid circulation system 250 first comprises fluid passageways defined in the cathode aperture shield 58 and the anode housing 104. The aperture shield 58 preferably includes on its exterior surface a plurality of extended surfaces, or cooling surfaces 64. The outer ends of the cooling surfaces 64 may abut against a cathode sleeve 66 that is circumferentially disposed about the aperture shield 58 such that multiple fluid passageways 68 are created between adjacent cooling surfaces. The fluid passageways 68 are in fluid communication with fluid inlet and outlet ports 70A and 70B defined in the cathode sleeve 66 (see FIGS. 3A and 3B). Further details concerning this portion of the fluid circulation system 250 are disclosed in an application for United States patent filed on Jul. 12, 1999, Ser. No. 09/351,579, which is hereby incorporated by reference in its entirety. The fluid inlet port 70A is in fluid communication with a fluid input conduit 252A, which connects to a fluid pump 254 and a cooling unit 256, as described more fully below.

The closed end 104B of the anode housing 104 also preferably defines a plurality of interconnected annular fluid passageways 258. The fluid passageways 258 are preferably in fluid communication with the fluid passageways 68 of the cathode aperture shield 58 such that cooling fluid may circulate in series first through the passageways 68 of the cathode aperture shield, then through the passageways 258 of the anode housing 104 during the fluid cooling/circulation process described below.

The aforementioned fluid circulation system 250 is utilized to provide critical tube cooling during the production of x-rays. One area where cooling is needed is the cathode aperture shield 58. During tube operation, a significant portion of electrons produced by the filament 56 impacts the inner portion of the cathode aperture shield 58, thereby creating heat. This heat is conducted through the aperture shield 58 to the cooling surfaces 64. Cooling fluid is pumped through the inlet port 70A of the cathode sleeve 66 and into the fluid passageways 68 of the aperture shield 58 via the fluid pump 254. As the cooling fluid circulates past the cooling surfaces 64, heat is transferred from the surfaces to the fluid, thereby removing the heat from the cathode aperture shield 58. The cooling fluid is still capable of accepting more heat, however, and thus it is pumped through the outlet port 70B toward the anode housing 104.

As discussed above, heat created in the anode 106 during tube operation is conducted to the area of the anode substrate 110 immediately surrounding the annular grooves 114. This heat is continuously radiated from the substrate 110 to the annular extended surfaces 116 defined on the anode housing closed end 104B that interleave with the grooves 114. The heat is then conducted to the area immediately surrounding the fluid passageways 258. Cooling fluid received from the outlet port 70B of the cathode sleeve 66 is introduced through an inlet port (not shown) in the anode housing 104. The cooling fluid circulating through the fluid passageways 258 remove the heat that has been conducted to the area of the anode housing closed end 104B immediately surrounding the fluid passageways 258. The cooling fluid, after receiving the heat, then exits the anode housing 104 through a fluid outlet port (not shown), where it is transported via the outlet conduit 252B to the pump 254 and cooling unit 256, where the fluid is cooled and conditioned. After conditioning, the cooling fluid is recirculated by the pump 254 to the interior of the x-ray ray tube 10 via the input conduit 252A to again cool the cathode aperture shield 58 and the anode assembly 102. In this way, excessive heat is continuously and reliably removed from the x-ray tube 10 by a cooling fluid, thereby protecting the tube components from excessive heat damage.

Though the above fluid cooling process circulates the cooling fluid first to the fluid passageways defined in the cathode aperture shield, then to the fluid passageways defined in the anode housing, the reverse process could also be utilized. Also, other or additional areas of the x-ray tube could have defined therein fluid passageways through which the cooling fluid could flow to remove heat therefrom. Moreover, additional components could comprise the fluid circulation system 250, as may be appreciated by one of skill in the art. Accordingly, the fluid circulation system 250 disclosed herein is exemplary of a preferred embodiment thereof, and should not be considered as limiting the scope of the present invention in any way.

Figure 4:
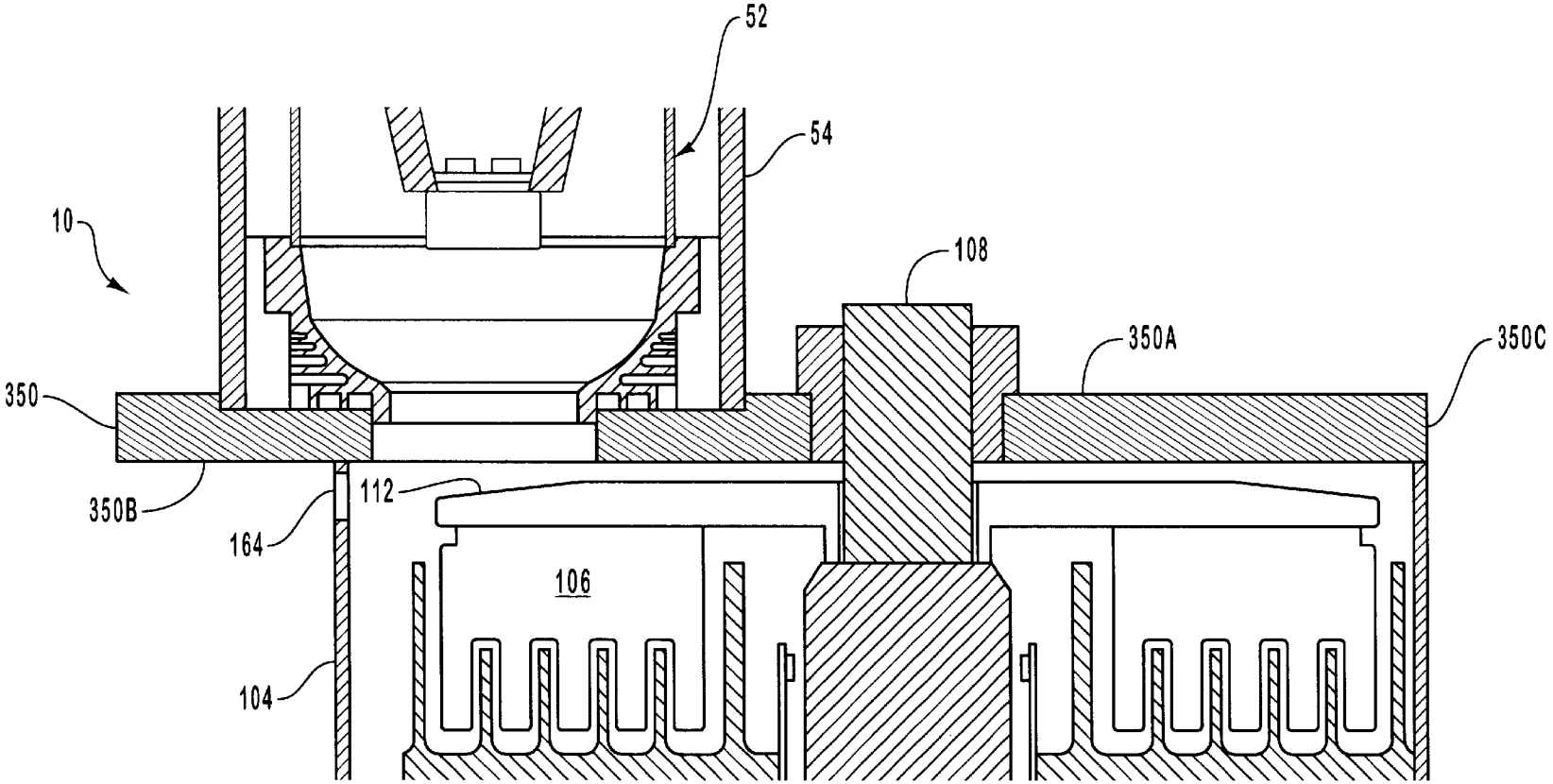
FIG. 4 is a cross-sectional side view of another embodiment of the x-ray tube of the present invention.
Figure 5A:
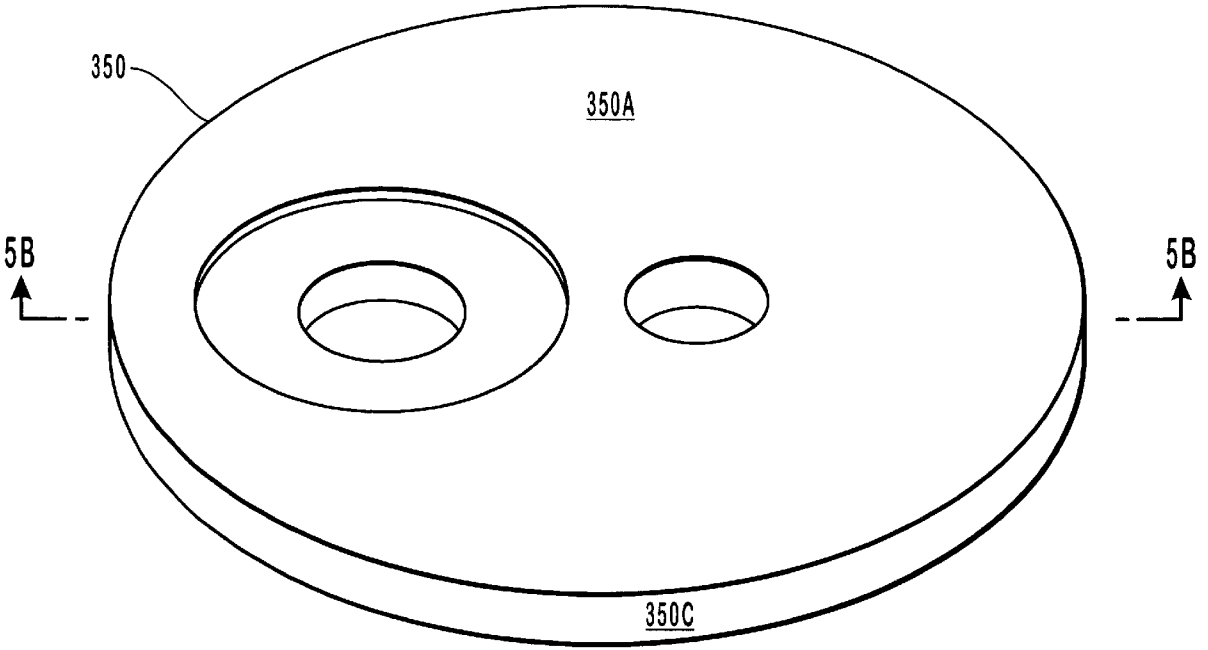
FIG. 5A is a perspective view of the adapter plate included in another embodiment of the present invention.
Figure 5B:
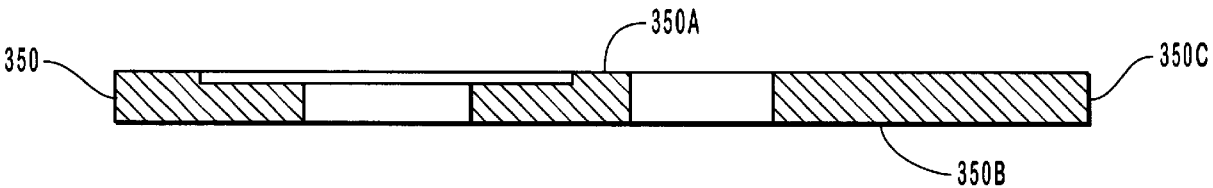
FIG. 5B is a cross-sectional side view of the adapter plate of FIG. 5A, taken along the line B—B.

Reference is now made to FIGS. 4, 5A, and 5B, wherein details of another embodiment of the present invention are disclosed. As depicted in the figures, the improved x-ray 10 includes an adapter plate 350 having a first side 350A, a second side 350B, and a circumferential edge 350C. The adapter plate is hermetically attached to both the cathode assembly 52 and the anode housing 104, as before. Also as in the preferred embodiment, two holes 154 and 156 are defined on the first side 350A of the plate 350 for receiving a portion of the cathode assembly 52 and a portion of the anode support assembly 108. In contrast to the previous preferred embodiment, however, the second side 350B of the adapter plate 350 is planar and does not include a cavity 152 defined therein for receiving any portion of the target surface 112 of the anode 104. Instead, the anode 104 is suspended via the anode support assembly 108 such that the target surface 112 is disposed a small distance below the second side of the adapter plate 350. In this embodiment, then, the two holes 154 and 156 extend to the second side 350B of the adapter plate 350, and the window 164 is disposed in the anode housing 104 below the adapter plate 350.

Figure 6:
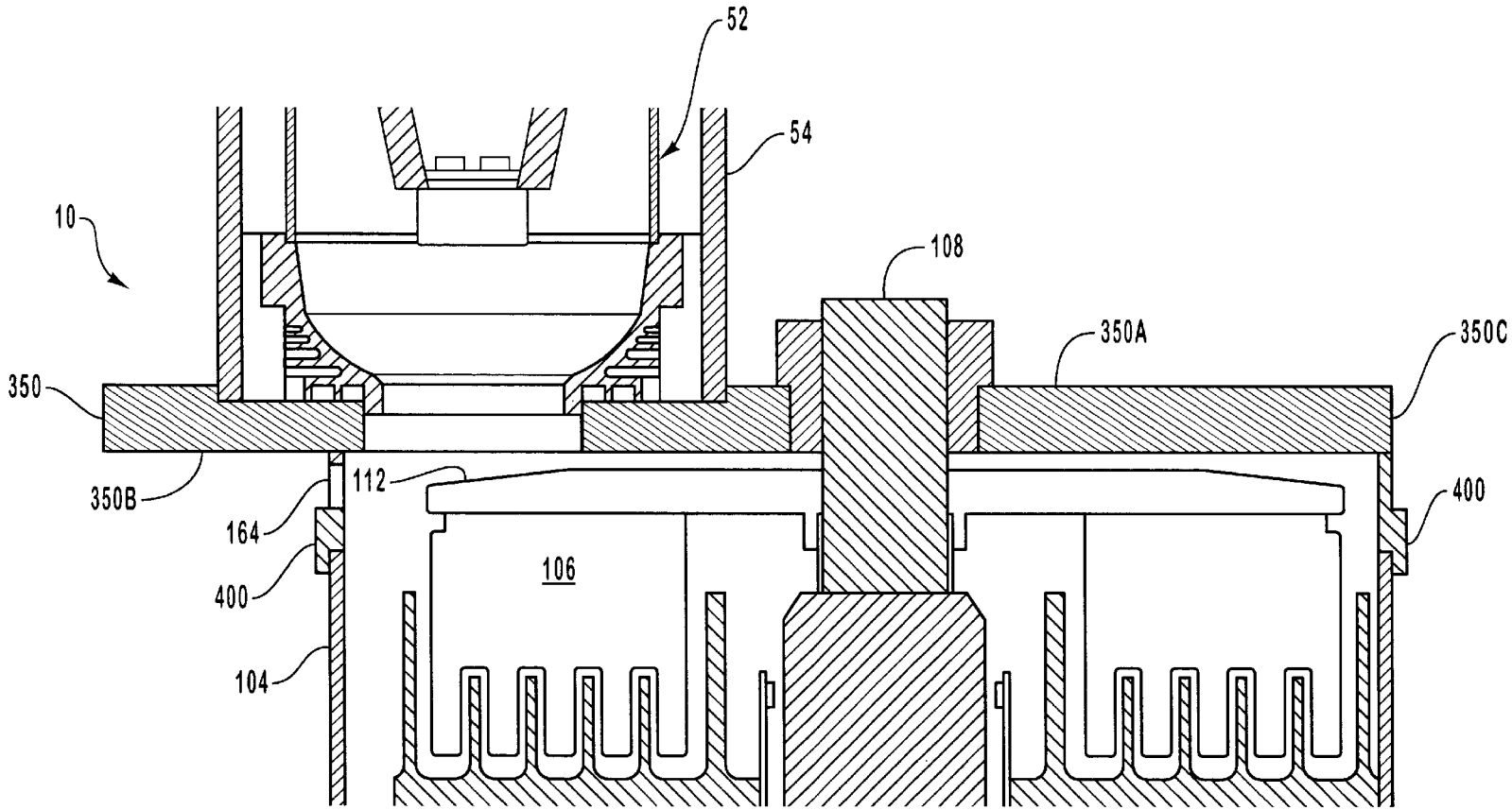
FIG. 6 is a cross-sectional side view of yet another embodiment of the x-ray tube of the present invention.

Reference is now made to FIG. 6, wherein is depicted yet another embodiment of the present x-ray tube 10. As in the previous embodiment, the x-ray tube 10 includes an adapter plate 350 having hermetically attached thereto the cathode assembly 52. In this embodiment, an extension ring 400 is also hermetically attached to the adapter plate 350 via brazing, welding, or the like. The extension ring 400 comprises an annular band preferably composed of stainless steel, and has disposed within it the window 164 through which the x-rays 160 may pass. The anode housing 104 is hermetically attached (by brazing, welding, or the like) to the opposite end of the band to which the adapter plate 350 is attached. Thus the unitary vacuum enclosure 300 in this embodiment comprises the cathode assembly 52, the adapter plate 350, the extension ring 400, and the anode housing

104. The extension ring 400 of the present embodiment may be utilized to more easily accommodate the mating of the anode housing 104 to the adapter plate 350. To this end, the extension ring 400 may comprise a variety of shapes and configurations in order to provide a joining surface for both the anode housing 104 and the adapter plate 350 that facilitates brazing or welding. The extension ring 400 may also be utilized to facilitate the joining of an existing anode housing to an adapter plate, thereby making possible the retrofitting of existing anode housings to adapter plates in order to produce the present improved x-ray tube 10.

In summary, the present invention features a means for joining a cathode assembly to an anode housing to form the unitary vacuum enclosure and housing of the present improved x-ray tube. One such means is provided in FIG. 1, wherein an adapter plate hermetically receives the cathode assembly and the anode housing. This arrangement makes possible the elimination of a fluid-filled outer housing typically used to contain and cool the vacuum enclosure. Limited fluid and air cooling of the vacuum enclosure is achieved through a fan assembly disposed near the tube stator, and fluid passageways defined in the cathode aperture shield and the anode housing. Other means for joining the cathode assembly to the anode housing are provided in FIGS. 3 and 6, wherein the adapter plate comprises different physical dimensions and features, and wherein the plate may also include an extension ring for facilitating the joining of the anode housing thereto. Indeed, the present invention contemplates that the size, shape and physical features of the adapter plate and connected components of the present invention could be modified as appreciated by one of skill in the art, while still preserving the functionality disclosed herein. Embodiments of the present x-ray tube in addition to those discussed herein, then, are accordingly contemplated as residing within the present invention.

The improved x-ray tube of the present invention presents a simpler and cheaper design than known tubes. Because of the elimination of the fluid-filled outer housing normally disposed about known x-ray tubes, the present x-ray tube may be manufactured to be smaller and lighter than prior devices. As a result, the present x-ray tube may be manufactured at a lower cost than previously possible. Further, the space saved by the improved design enables the utilization of that space by other tube components, thereby further enhancing the performance of the present x-ray tube.

The present invention may be embodied in other specific forms without departing from its spirit or essential characteristics. The described embodiments are to be considered in all respects only as illustrative, not restrictive. The scope of the invention is, therefore, indicated by the appended claims rather than by the foregoing description. All changes that come within the meaning and range of equivalency of the claims are to be embraced within their scope.

What is claimed is:

1. An x-ray tube comprising:

a cathode assembly having disposed therein a cathode for emitting electrons, the cathode assembly defining at least one fluid passageway through which a cooling fluid may be circulated;

an anode housing having disposed therein an anode assembly positioned to receive the electrons emitted by the cathode; and an adapter plate attached at least indirectly to the cathode assembly and to the anode housing, and the adapter plate defining an opening that is at least partially hermetically sealed by a portion of the anode assembly.

2. An x-ray tube as defined in claim 1, wherein the adapter plate defines a first hole for receiving at least a portion of the cathode assembly, and wherein the opening defined by the adapter plate comprises a second hole for receiving at least a portion of the anode assembly.

3. An x-ray tube as defined in claim 2, wherein the adapter plate comprises a disk having a first side, a second side, and an edge, the first side being co-planar with the second side, the first and second holes defined from the first side to the second side.

4. An x-ray tube as defined in claim 1, wherein the adapter plate substantially comprises a metallic material.

5. An x-ray tube as defined in claim 4, wherein the adapter plate substantially comprises stainless steel.

6. An x-ray tube as defined in claim 1, wherein the adapter plate further comprises a window disposed therein.

7. An x-ray tube as defined in claim 1, further comprising a window disposed in the anode housing.

8. An x-ray tube as defined in claim 1, further comprising a cathode housing covering the cathode assembly.

9. An x-ray tube as defined in claim 8, wherein the cathode housing substantially comprises stainless steel.

10. An x-ray tube as defined in claim 8, wherein the cathode housing further comprises a layer of shielding for absorbing x-rays.

11. An x-ray tube as defined in claim 1, wherein the anode housing substantially comprises stainless steel.

12. An x-ray tube as defined in claim 1, wherein the cathode assembly and the anode housing are brazed to the adapter plate.

13. An x-ray tube as defined in claim 1, wherein the anode housing defines at least one fluid passageway through which a cooling fluid may be circulated.

14. An x-ray tube as defined in claim 1, wherein the anode is electrically grounded.

15. An x-ray tube as defined in claim 1, further comprising a layer of x-ray absorbing shielding disposed proximate an outer surface of the adapter plate and the anode housing.

16. An x-ray tube as defined in claim 1, further comprising a shroud having a fan disposed therein for circulating air proximate the x-ray tube.

17. An x-ray tube as defined in claim 16, wherein the fan shroud is fixedly attached to the anode housing.

18. An x-ray tube as defined in claim 17, further comprising at least one air inlet and at least one air outlet defined in the surface of the fan shroud.

19. An x-ray tube as defined in claim 1, further comprising an extension ring disposed between the anode housing and the adapter plate.

20. An x-ray tube as defined in claim 19, further comprising a window disposed in the outer surface of the extension ring.

21. An x-ray device comprising:

a cathode assembly including:

a cathode housing:

a cathode for emitting electrons, the cathode being substantially disposed within the cathode housing; and an anode assembly including:

an anode housing;

an anode supported on a mounting ring and shaft, the anode being substantially disposed within the anode housing and positioned to receive electrons emitted by the cathode; and an adapter plate having first and second sides and attached at least indirectly to the cathode housing and to the anode housing, the adapter plate defining a first hole hermetically sealed on the first side of the adapter plate by the cathode housing, and the adapter plate defining a second hole hermetically sealed on the first side of the adapter plate by the shaft and the mounting ring.

22. An x-ray device comprising:

a cathode assembly including:

a cathode housing:

a cathode for emitting electrons, the cathode being substantially disposed within the cathode housing;

a cathode aperture shield; and an anode assembly including:

an anode housing;

an anode substantially disposed within the anode housing and positioned to receive electrons emitted by the cathode and passing through the cathode aperture shield;

an adapter plate hermetically sealed to the cathode and anode housings and to at least a portion of the anode assembly;

a cooling system in fluid communication with at least one of: the cathode assembly; and, the anode assembly; and shielding disposed proximate a portion of the x-ray device.

23. An adapter plate for use in an x-ray tube, the x-ray tube comprising a cathode assembly substantially disposed in a cathode housing, and an anode assembly substantially disposed in an anode housings, the adapter plate comprising:

a metallic portion having a first side, a second side, and an edge and defining a first hole and a second hole, the first hole being configured to receive a portion of the cathode assembly and the second hole being configured to be at least partially hermetically sealed by a portion of the anode assembly, the metallic portion further comprising a substantially circular cavity defined on the second side of the metallic portion for receiving therein a portion of the anode assembly.

24. An adapter plate as defined in claim 23, wherein the adapter plate substantially comprises stainless steel.

25. An adapter plate as defined in claim 23, wherein the adapter plate is substantially circular.

26. An adapter plate as defined in claim 23, wherein the substantially circular cavity is in communication with the first and second hole.

27. An adapter plate as defined in claim 26, further comprising a tunnel defined from the edge of the adapter plate to the inner surface of the circular cavity, and wherein a window comprising beryllium is disposed in the tunnel.

28. An x-ray tube system comprising:

a cathode housing having disposed therein a cathode assembly, the cathode assembly comprising:

a filament for emitting electrons;

an aperture shield disposed about the filament, the aperture shield having an opening defined therein through which electrons emitted by the filament are passed;

a cathode sleeve having an inlet and an outlet port, the inlet port receiving a cooling fluid;

at least one passageway formed within the shield, wherein the passageway receives the cooling fluid from the inlet port and discharges the cooling fluid at the outlet port, the cooling fluid thereby absorbing heat from the shield; and a plurality of adjacent extended cooling surfaces that are disposed about the outer periphery of the shield, and wherein the inlet port directs at least a portion of the cooling fluid passed through the passageway formed within the shield to flow across the surface of the fins, and thereby increase the rate of heat transferred from the shield to the cooling fluid;

an anode housing having partially disposed therein an anode assembly, the anode assembly comprising:

a rotary anode having a substrate upon which is disposed a target surface for receiving electrons emitted by the filament;

a support shaft for supporting the rotary anode;

a bearing assembly rotatably interconnecting the rotary anode and the support shaft; and at least one fluid passageway defined in the anode housing for allowing a cooling fluid to pass through and thereby absorb heat from at least a portion of the anode housing, wherein the fluid passageway defined in the anode housing receives the cooling fluid from the outlet port of the cathode sleeve; an adapter plate attached to both the cathode assembly and the anode housing to form a vacuum enclosure therewith, the adapter comprising:

a first side, a second side, and a circumferential edge;

a first hole defined through the adapter plate for receiving a portion of the cathode assembly, the aperture of the cathode assembly being aligned with the first hole such that electrons emitted by the filament may pass through the first hole;

a second hole defined through the adapter plate, the second hole having disposed therein a sleeve for receiving a portion of the support shaft of the anode assembly;

a circular cavity defined on the second side of the adapter plate that defines a volume in which a portion of the rotary anode is disposed;

a tunnel defined from the circumferential edge of the adapter plate to the inner surface of the circular cavity; and a window disposed at the outer end of the tunnel; and a fluid circulation system for circulating a cooling fluid through the fluid passageways of the cathode assembly and the anode housing.

29. An x-ray tube system as defined in claim 28, wherein the cathode assembly and the anode housing are brazed to the adapter plate.

30. An x-ray tube system as defined in claim 29, wherein the fluid circulation system further comprises:

a fluid pump;

a cooling unit comprising a heat exchanger; and a first fluid conduit for transferring the cooling fluid from the fluid pump and the cooling unit to the inlet port of the cathode sleeve, and a second fluid conduit for transferring the cooling fluid from the at least one fluid passageway defined in the anode housing to the pump and cooling unit.

31. An x-ray tube system as defined in claim 30, further comprising a stator disposed proximate the anode assembly.

32. An x-ray tube system as defined in claim 31, further comprising an air cooling system for cooling the stator, the air cooling system comprising:

a hollow cylindrical shroud affixed to the anode housing, the shroud having disposed therein the stator, the shroud also having at least one air inlet and at least one air outlet defined on the surface thereon;

a fan having blades for circulating air about the stator; and a motor for rotating the fan.

33. An x-ray tube system as defined in claim 32, wherein the cathode housing, the anode housing, and the adapter plate comprise stainless steel.

34. An x-ray tube system as defined in claim 33, further comprising a layer of shielding for absorbing x-rays, wherein the shielding is disposed proximate the anode housing, the adapter plate, and the cathode housing.

35. An x-ray tube system as defined in claim 34, wherein the layer of shielding comprises lead.

36. An x-ray tube system as defined in claim 35, wherein the rotary anode substrate further comprises a plurality of annular grooves defined in the bottom surface of the substrate.

37. An x-ray tube system as defined in claim 36, wherein the anode housing further comprises a plurality of annular extended surfaces that interleave with the annular grooves of the anode substrate, whereby heat may be transferred from the anode substrate to the anode housing.

38. An x-ray tube system as defined in claim 37, wherein the at least one fluid passageway defined in the anode housing comprises a plurality of interconnected annular passageways through which the cooling fluid flows.

39. An adapter plate for use in connection with an x-ray tube that includes a cathode assembly that substantially resides within a cathode housing and an anode assembly that substantially resides within an anode housing, the adapter plate comprising:

a metallic portion having first and second sides and including an edge, the metallic portion defining a first hole configured and arranged to receive a portion of the cathode assembly, and the metallic portion defining a second hole configured and arranged to be at least partially hermetically sealed by a portion of the anode assembly, the metallic portion further defining a depression disposed about the first hole.

40. The adapter plate as recited in claim 39, wherein the second hole is relatively smaller in diameter than the first hole.

41. The adapter plate as recited in claim 39, wherein the metallic portion substantially comprises stainless steel.

42. The adapter plate as recited in claim 39, wherein the first and second holes are eccentric with respect to the metallic portion.

43. The adapter plate as recited in claim 39, wherein the metallic portion defines a tunnel and an inner plate cavity in communication with each other, the tunnel extending through the edge of the plate.

44. The adapter plate as recited in claim 43, further comprising a window attached over the tunnel at the edge of the plate.

45. The adapter plate as recited in claim 43, wherein the inner plate cavity is configured and arranged to house a portion of the anode assembly.

46. The adapter plate as recited in claim 43, wherein the first and second holes are in communication with the inner plate cavity.

47. An x-ray device comprising:

a cathode assembly including:

a cathode housing:

a cathode for emitting electrons, the cathode being substantially disposed within the cathode housing; and an anode assembly including:

an anode housing:

an anode supported on a mounting ring and shaft, the anode being substantially disposed within the anode housing and positioned to receive electrons emitted by the cathode; and an adapter plate having first and second sides and attached at least indirectly to the cathode housing and to the anode housing, the adapter plate defining a first hole hermetically sealed on the first side of the adapter plate by the cathode housing, and the adapter plate defining a second hole hermetically sealed on the first side of the adapter plate by the shaft and the mounting ring, the adapter plate further defining a tunnel having an outer end through which at least some x-rays, generated as a result of the impact on the anode of electrons emitted by the cathode, pass.

48. The x-ray device as recited in claim 47, further comprising a cathode aperture shield interposed between the cathode and the anode and attached to the adapter plate.

49. The x-ray device as recited in claim 47, further comprising a cooling system configured for fluid communication with at least one of: the cathode assembly; and the anode assembly.

50. The x-ray device as recited in claim 47, wherein a fluid passageway is defined by at least one of: the cathode assembly; and, the anode assembly.

51. The x-ray device as recited in claim 47, further comprising an extension ring interposed between the anode housing and the adapter plate.

52. The x-ray device as recited in claim 47, further comprising a window attached to the outer end of the tunnel.

53. The x-ray device as recited in claim 47, wherein the adapter plate defines a depression configured and arranged to receive a portion of the cathode assembly.

54. The x-ray device as recited in claim 47, wherein the adapter plate defines an inner plate cavity wherein a portion of the anode is positioned.

55. The x-ray device as recited in claim 54, wherein the first and second holes of the adapter plate are in communication with the inner plate cavity.

56. The x-ray device as recited in claim 47, further comprising shielding disposed proximate a portion of the x-ray device.

57. The x-ray device as recited in claim 47, further comprising an air cooling system for cooling a portion of the x-ray device.

58. The x-ray device as recited in claim 51, wherein the extension ring includes a window through which at least some x-rays pass, the x-rays being generated as a result of the impact on the anode of electrons emitted by the cathode.

* * * * *

UNITED STATES PATENT AND TRADEMARK OFFICE

CERTIFICATE OF CORRECTION

PATENT NO. : 6,674,838 B1
DATED : January 6, 2004
INVENTOR(S) : Vaughn Leroy Barrett It is certified that error appears in the above-identified patent and that said Letters Patent is hereby corrected as shown below:

Column 2,
Line 6, change “buildup” to -- build up --

Column 5,
Line 49, change “an stream” to -- a stream --

Column 8,
Line 18, change “104via” to -- 104 via --
Line 30, change “In this” to -- In this way, the stator 124 is effectively cooled during tube operation. --

Column 13,
Line 28, change “housings,” to -- housing, --

Signed and Sealed this

Sixth Day of July, 2004

JON W. DUDAS
*Acting Director of the United States Patent and Trademark Office*